US011746984B2

(12) United States Patent
Heitjohann et al.

(10) Patent No.: US 11,746,984 B2
(45) Date of Patent: Sep. 5, 2023

(54) ILLUMINATION DEVICE FOR VEHICLES

(71) Applicant: HELLA GmbH & Co. KGaA, Lippstadt (DE)

(72) Inventors: Peter Heitjohann, Rheda-Wiedenbrueck (DE); Sebastian Scholz, Soest (DE); Markus Stuhldreher, Olsberg (DE); Franz-Georg Willeke, Anroechte (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/956,419

(22) Filed: Sep. 29, 2022

(65) Prior Publication Data

US 2023/0028522 A1 Jan. 26, 2023

Related U.S. Application Data

(63) Continuation of application No. PCT/EP2021/056368, filed on Mar. 12, 2021.

(30) Foreign Application Priority Data

Mar. 31, 2020 (DE) ..... 10 2020 108 943.0

(51) Int. Cl.
*F21S 43/245* (2018.01)
*F21S 43/249* (2018.01)
(Continued)

(52) U.S. Cl.
CPC ..... *F21S 43/245* (2018.01); *F21S 43/249* (2018.01); *F21S 43/31* (2018.01); *F21S 43/14* (2018.01)

(58) Field of Classification Search
CPC ..... F21S 41/26
See application file for complete search history.

(56) References Cited

U.S. PATENT DOCUMENTS

2004/0130904 A1* 7/2004 Yamada ..... B60Q 1/2607 362/487
2008/0002421 A1* 1/2008 Tamaki ..... G02B 6/001 362/552

(Continued)

FOREIGN PATENT DOCUMENTS

DE 10149044 A1 4/2003
DE 102013016764 A1 4/2015

(Continued)

OTHER PUBLICATIONS

International Search Report dated May 11, 2021 in corresponding application PCT/EP2021/056368.

*Primary Examiner* — Eric T Eide
(74) *Attorney, Agent, or Firm* — Muncy, Geissler, Olds & Lowe, P.C.

(57) ABSTRACT

An illuminating device for vehicles, including an elongated light guide, which has an end face for coupling light into the light guide and has a lateral surface, at which the coupled-in light may be totally reflected in a coupling direction. An elongated reflector is arranged so that it follows the light guide and at least partially behind the light guide in the main emission direction. The light guide is designed such that the coupled-in light is coupled out on a rear-side lateral surface and/or side lateral surface facing the reflector and on a front lateral surface facing away from the reflector. The light guide and the reflector each have a corner region, in which sections of the light guide and sections of the reflector enclose an acute or right or obtuse angle.

12 Claims, 2 Drawing Sheets

(51) Int. Cl.
*F21S 43/31* (2018.01)
*F21S 43/14* (2018.01)

(56) References Cited

U.S. PATENT DOCUMENTS

| | | | | |
|---|---|---|---|---|
| 2009/0284365 | A1* | 11/2009 | Wagner | B60R 1/1207 362/494 |
| 2012/0069592 | A1* | 3/2012 | Natsume | F21S 43/237 362/511 |
| 2016/0053962 | A1 | 2/2016 | Akutsu | |
| 2016/0215950 | A1 | 7/2016 | Ender et al. | |
| 2018/0284335 | A1 | 10/2018 | Godbillon et al. | |
| 2019/0309923 | A1* | 10/2019 | Schall | G02B 6/0006 |
| 2019/0389364 | A1* | 12/2019 | Shah | F21S 43/315 |
| 2020/0003383 | A1 | 1/2020 | Takenaga et al. | |
| 2021/0229595 | A1* | 7/2021 | Watanabe | B60Q 1/2665 |
| 2023/0010327 | A1* | 1/2023 | Michaelis | F21S 43/26 |

FOREIGN PATENT DOCUMENTS

| | | | |
|---|---|---|---|
| JP | 2013171678 | A | 9/2013 |
| JP | 2014203547 | A | 10/2014 |
| JP | 2015159049 | A | 9/2015 |
| JP | 2015198019 | A | 11/2015 |
| JP | 2017220394 | A | 12/2017 |

* cited by examiner

ILLUMINATION DEVICE FOR VEHICLES

This nonprovisional application is a continuation of International Application No. PCT/EP2021/056368, which was filed on Mar. 12, 2021, and which claims priority to German Patent Application No. 10 2020 108 943.0, which was filed in Germany on Mar. 31, 2020, and which are both herein incorporated by reference.

BACKGROUND OF THE INVENTION

Field of the Invention

The present invention relates to an illuminating device for vehicles.

Description of the Background Art

An illuminating device for vehicles is known from DE 101 49 044 A1, which includes an elongated light guide, at the end face of which light is coupled in. The light guide has a corner region, two sections of the light guide leading to the corner region enclosing a relatively small or acute angle. The outside of the corner region includes dispersing elements so that no light emerges on an outside of the corner region as a result of the steep angle of incidence, which would result in a light emergence. The dispersing elements cause the coupled-in light striking them to be reflected back and thus to remain within the light guide.

An illuminating device for vehicles is known from DE 10 2013 016 764 A1, which includes an elongated light guide as well as an elongated reflector which follows a contour of the light guide. The reflector is arranged essentially behind the light guide and has a width extension, which is greater than a width extension of the light guide. A reflector surface of the reflector reflects the light emerging at a rear-side lateral surface and a side lateral surface of the light guide in the main emission direction, so that a luminous band occurs in the main emission direction, which is wider than the light guide. The light guide and the reflector have a corner region, in which an increased luminous flux occurs, due to the light emerging from the light guide in the direction of the reflector. The light concentration generated hereby in the corner region results in an inhomogeneity of the light distribution of the light guide.

SUMMARY OF THE INVENTION

It is therefore an object of the present invention to provide an illuminating device, which contains an elongated light guide and an elongated reflector, in such a way that a homogeneous light distribution is easily ensured in the longitudinal direction of the illuminating device, even if the light guide and the reflector extend in a curved manner with a relatively small radius of curvature.

According to an exemplary embodiment of the invention, the reflector can have a non-reflective section in a corner region thereof, at which the light emerging from the assigned light guide (scattered light) is not reflected in the main emission direction of the illuminating device. As a result, a light concentration or increased luminosity advantageously does not occur in the corner region. The illuminating device thus has a homogeneous light distribution over its entire length. The reflector surface of the reflector is preferably smaller in the curved corner region thereof than in a straight section of the reflector.

The non-reflective section in the corner region can pass over an end of a first section and an end of a second section of the light guide as well as a corner of the light guide connecting the first section to the second section. A dimension and/or a size of the non-reflective section is/are selected in such a way that the luminosity of the corner region of the illuminating device essentially corresponds to the luminosity of the adjacent first section and the second section of the illuminating device. The size and/or the dimension of the non-reflective section of the reflector may also depend, for example, on the enclosed angle of the corner region.

The non-reflective section can be arranged in a region of the reflector near the apex. The non-reflective section preferably extends on a side of the light guide situated counter to the main emission direction. This advantageously prevents light emerging from the rear-side lateral surface of the light guide from being reflected back by the reflector, which would thus result in an increase in the luminous flux.

The non-reflective section can be designed as a recess. This causes the light coupled out at the rear-side lateral surface of the light guide to shine through the reflector toward the rear and to be absorbed in a housing of the illuminating device or to stray therein in such a way that it no longer emerges from the housing of the illuminating device in the main emission direction. The recess may advantageously be manufactured as early as the manufacture of the reflector (injection molding), so that no additional part or an additional process is needed. The light guide also does not have to be modified.

The front-side lateral surface of the light guide can be arranged so as to be partially covered by the reflector in the corner area of the light guide. A portion of the light coupled out from the light guide on the front side may thus not be radiated in the main emission direction/direction of travel. The luminous flux emerging from the light guide in the corner region thereof may thus be reduced to the luminous flux emitted from the straight sections of the light guide.

The recess of the reflector in the corner region thereof can be designed in such a way that a leg of the reflector runs in front of the light guide in the main emission direction. The reflector is provided with a more bulbous design in its corner region than in the straight sections of the reflector. The recess preferably extends at least partially along an outer leg of the reflector, which runs along a region of the reflector on the outside of the curve. The region of the reflector on the inside of the curve preferably does not cover the light guide. The mechanical stability of the reflector is advantageously ensured since the region of the reflector on the inside of the curve is provided with material or may be reinforced with material.

The reflector can have a radius of curvature in its corner region, which is larger than a radius of curvature of the light guide in the corner region. In the corner region, the light guide is arranged in a region of the reflector on the outside of the curve, whereby it is at least partially covered by the leg of the reflector on the outer side of the curve.

Tight guide can include coupling-out elements on the rear-side lateral surface, which deflect the coupled-in light striking them in the main emission direction. As a result, the legal minimum requirements for luminosity may be advantageously met by the light guide alone. The reflector is used only to support the homogeneity of the emitted light but is not necessary for the light function.

The light guide can include a coupling-out structure, so that coupled-in light striking the coupling-out structure is deflected in the direction of the front-side lateral surface of the light guide. The emerging luminous flux may be advantageously better controlled or set hereby.

According to one refinement of the invention, the light guide does not have any coupling-out structure in its corner region, while it does have coupling-out structure in the region adjacent to the corner region. The luminous flux in the corner region may be advantageously reduced hereby, so that the size of the non-reflective section of the reflector may be made smaller to ensure a homogeneous light distribution of the illuminating device over its entire length.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
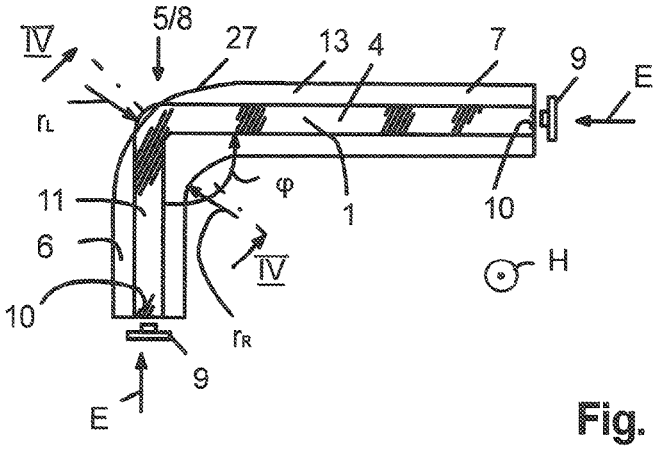
FIG. 1 shows a schematic front view of an illuminating device according to the invention.

An illuminating device for vehicles can be used to generate a daytime running light function or a navigation light function or a turn-signal function. It is preferably arranged, for example, in a front region of the vehicle.

The illuminating device is arranged in a housing, which is not illustrated, in which further lighting modules are preferably arranged for generating low-beam light, high-beam light and the like.

The illuminating device according to the invention includes an elongated light guide 1 as well as an elongated reflector 2, which follows the extension of light guide 1.

Light guide 1 has a straight first section 3 as well as a straight second section 4, first section 3 and second section 4 converging in a corner region 5. Reflector 2 has a straight first section 6 and a straight second section 7, first section 6 and second section 7 converging in a corner region 8. In the present exemplary embodiment, first section 3 and second section 4 of light guide 1 as well as first section 6 and second section 7 of reflector 2 each enclose a right angle φ. According to an alternative specific embodiment of the invention, which is not illustrated, particular sections 3, 4 and 6, 7, respectively, may also enclose an obtuse angle or an acute angle φ. Light guide 1 and reflector 2 are thus provided with a curved design or have a curve in the longitudinal direction.

A light source 9 is assigned to a free end of first section 3 and a free end of second section 4 of light guide 1 in each case, the light source being arranged on an end face 10 of the free end of first section 3 and second section 4. Light source 9 may be designed, for example, as an LED light source. End face 10 may preferably include a coupling lens. A lateral surface 11 abuts end face 10 of light guide 1, which is used as the light coupling surface, at which light 12 coupled in at end face 10 is totally reflected in coupling-in direction E and is thus passed on in the longitudinal extension of light guide 1. A further portion of the coupled-in light is coupled out at lateral surface 11, since the corresponding light beams strike lateral surface 11 at a steeper angle than the light beams totally reflected at lateral surface 11. The angle of incidence of the light beams refracted at lateral surface 11 is smaller than the limiting angle for the total reflection.

In the present exemplary embodiment, light guide 1 is provided with a circular design in cross section. Reflector 2 is provided with a U-shaped design in cross section. Reflector 2 is arranged at a distance from light guide 1. A flat side of reflector 2 facing light guide 1 is designed as a reflector surface 13, at which a light 12' coupled out from a rear-side lateral surface 11; of light guide 1 as well as a light 12" coupled out from a side lateral surface 11" are reflected in main emission direction H of the illuminating device.

In the present exemplary embodiment, reflector 2 extends from a first long marginal edge 14 to a second long marginal edge 15 at an opening angle α of 180°. If reflector 2 encompasses light guide 1 only at an acute or right angle α, only light 12' coupled out from rear-side lateral surface 11' may be reflected by reflector 2. Alternatively, opening angle α of reflector 2 may also be an obtuse angle.

Since reflector surface 13 is always arranged at a distance from light guide 1 in the circumferential direction, reflector 2 has a greater width extension $b_R$ than a width extension $b_L$ of light guide 1. Die to the fact that reflector surface 13 is designed in such a way that light 12', 12" striking it is reflected in main emission direction H, a luminous band 16 is generated with the aid of the illuminating device, which is made up of a light portion 16' emitted from a front-side lateral surface 11 of light guide 1, on the one hand, and of a light portion 16" shining from reflector 2 past light guide 1. The width of the luminous band corresponds to width $b_R$ of reflector 2 and is thus greater than width $b_L$ of light guide 1.

In order for relatively homogeneous light 16, which is made up of first light portions 16' and 16", to be emitted over the entire length of the illuminating device, reflector 2 has a non-reflective section 17 in corner region 8. If reflector 2 were to have the same reflection properties in corner region 8 as in elongated sections 6, 7, light having an increased luminous flux would be coupled out in corner area 8, which would result in an undesirable light concentration or light inhomogeneity.

Figure 2:
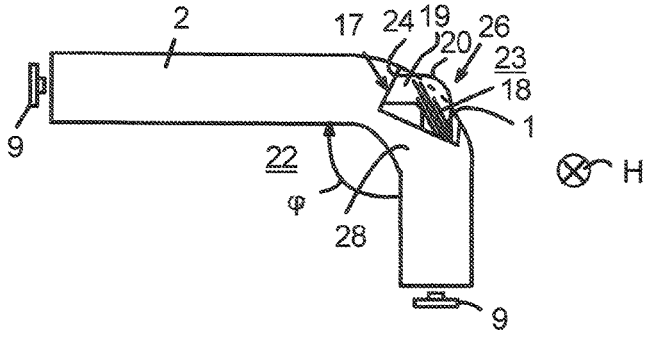
FIG. 2 shows a schematic rear view of an illuminating device according to the invention.

As is apparent from FIG. 2, in corner region 8, non-reflective section 17 passes over a non-free end 18 of first section 3 of light guide 1, a non-free end 19 of second section 4 of light guide 1 and a corner 20 of light guide 1, which connects the two ends 18, 19. In the present exemplary embodiment, non-reflective section 17 is designed as a recess or as an opening.

Non-reflective section 17 is designed as a trapezoidal surface, which, in the present exemplary embodiment, is provided with an open design. According to an alternative specific embodiment, which is not illustrated, non-reflective section 17 may be designed as a non-reflective, for example dark, surface. In this case, the entire front side of reflector 2 would not be provided with a reflective layer.

In the present exemplary embodiment, illuminating device 11 extends in an L-shaped manner in the longitudinal direction, enclosing angle φ running in a plane in corner region 8, which is arranged perpendicularly to main emission direction H.

Non-reflective section 17 preferably comprises an apex region of reflector 2. On an inner side 22 of corner region 8, reflector 2 extends continuously from first section 6 to second section 7 of reflector 2. On an outer side 23 of corner region 8, reflector 2 also extends with its reflector surface 13 continuously from first section 6 to second section 7 of reflector 2, so that a same-sized width of the luminous band is ensured in corner region 5 of the illuminating device as in straight sections 3, 4; 6, 7 of the illuminating device. First marginal edge 14 and second marginal edge 15 of reflector surface 13 of reflector 2 thus run continuously and uniformly without an abrupt change in direction. Recess 17 thus has a continuous opening edge 24, which is not interrupted. Opening edge 24 is preferably formed by cut edges of reflector 2.

Recess 17 of reflector 2 is arranged in the region of outer side 23 of corner region 8 or is arranged in the region of an outer or curve-outside leg 26 of reflector 2, an edge 27 of reflector 2 at a distance from the apex being arranged in front of light guide 1 or in front of front-side lateral surface 11" in main emission direction H. Light guide 1 is partially covered hereby, so that it is unable to emit such a great luminous flux at front-side lateral surface 11'" as would be possible if it were not covered by reflector 2. An inner or curve-internal leg 28 of reflector 2 is essentially arranged next to light guide 1, viewed in main emission direction H, and thus does not cover light guide 1.

Reflector 2 preferably has a larger radius of curvature $r_R$ in corner region 8 than a radius of curvature $r_L$ of light guide 1 in the same corner region 3.

According to an alternative specific embodiment of the invention, which is not illustrated, the illuminating device may also have a different shape, for example, a Z shape or U shape or the like. It is important that reflector 2 has a non-reflective section 17, which compensates for the increase in the luminous flux, in a corner region of the illuminating device.

In the present exemplary embodiment of the illuminating device, light guide 1 includes coupling-out structure or coupling-out elements 25 on rear-side lateral surface 11'. If the coupled-in light strikes a coupling-out structure 25 of this type, it is deflected by coupling-out structure 25 in main emission direction H to be coupled-out at front-side lateral surface 11'". Coupling-out structure 25 may be designed as a prism structure.

According to an alternative specific embodiment, light guide 1 does not include coupling-out structure in its corner region 5. The coupling out of light in corner region 5 thereof is reduced hereby.

Figure 3:
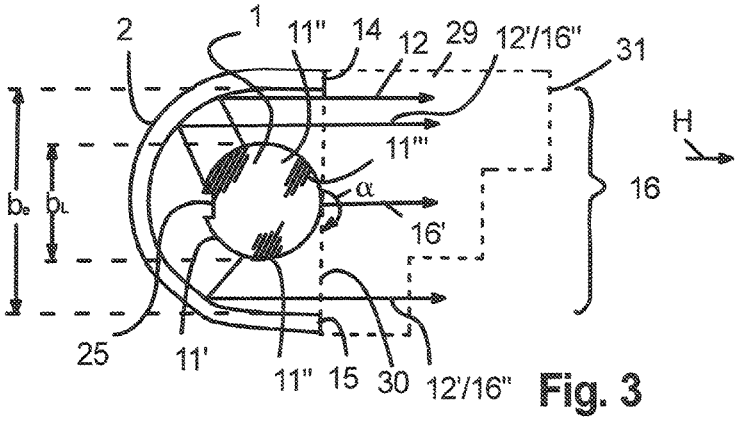
FIG. 3 shows a cross-section of the illuminating device according to the invention in a straight section thereof.
Figure 4:
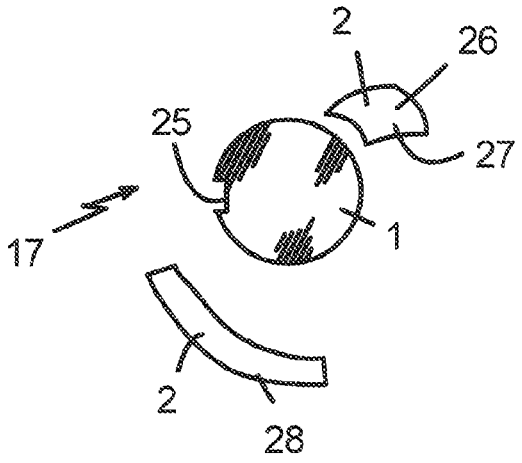
FIG. 4 shows a sectional view along line IV-IV in FIG. 1.

According to an alternative specific embodiment of the invention, the illuminating device may include a strip-shaped optical attachment element 29, which is arranged in front of light guide 1 and reflector 2 in main emission direction H. In FIG. 3, optical attachment element 29 is represented, for example, by the dashed line. Optical attachment element 29 has a flat rear side 30, which covers not only light guide 1 but also reflector 2. For this purpose, rear side 30 abuts marginal edges 14, 15 of reflector 2. Optical attachment element 29 has a front side 31, which is provided with a stepped design. Since optical attachment element 29 extends continuously over the entire length of the illuminating device, corner region 5, 7 of light guide 1 or reflector 2 is, in particular, cross-hatched.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An illuminating device for a vehicle, the illuminating device comprising:

an elongated light guide that has an end face to couple light into the light guide and has a lateral surface at which the coupled-in light is adapted to be totally reflected in a coupling direction; and an elongated reflector that is arranged so that it follows the light guide, the elongated reflector being arranged at least partially behind the light guide in a main emission direction of the illuminating device and having a reflector surface that has a greater width extension than the light guide, wherein the light guide is designed such that the coupled-in light is coupled out at a rear-side lateral surface and/or a side lateral surface facing the elongated reflector and/or at a front lateral surface facing away from the elongated reflector, wherein the light guide and the reflector each have a corner region, in which the light guide and the elongated reflector are each arranged in a curved manner around an acute or right or obtuse angle, wherein the elongated reflector has a non-reflective section in its corner region at which the light coupled out from the light guide in the direction of the elongated reflector is not reflected in the main emission direction, and wherein the non-reflective section is designed as a recess.

2. The illuminating device according to claim 1, wherein, in the corner region, the non-reflective section passes over an end of the first section of the light guide, an end of the second section of the light guide and a corner of the light guide, which connects the first section and the second section, in projection onto a plane running substantially perpendicularly to the main emission direction.

3. The illuminating device according to claim 1, wherein the non-reflective section forms a trapezoidal surface.

4. The illuminating device according to claim 1, wherein the non-reflective section is arranged at least in a region of the reflector near the apex.

5. The illuminating device according to claim 1, wherein the front lateral surface of the light guide is arranged so as to be partially covered by the reflector in the corner region thereof.

6. The illuminating device according to claim 1, wherein the recess of the reflector in the corner region is designed such that a leg of the reflector runs in front of the light guide in the main emission direction.

7. The illuminating device according to claim 1, wherein an outer leg of the reflector has the recess in its corner region, the outer leg being arranged in front of the side lateral surface facing the outer leg and/or in front of a portion of the front lateral surface of the light guide in the main emission direction.

8. The illuminating device according to claim 1, wherein the sections of the reflector in the corner region thereof have a radius of curvature which is greater than a radius of curvature formed by sections of the light guide in the corner region thereof.

9. The illuminating device according to claim 1, wherein at least one coupling-out element is arranged on the rear-side lateral surface of the light guide so that, when the coupled-in light strikes the coupling-out element, the coupled-in light is deflected in the main emission direction for the purpose of coupling out the light at the front-side lateral surface of the light guide.

10. The illuminating device according to claim 1, wherein the light guide does not include any coupling-out elements in the corner region.

11. The illuminating device according to claim 1, wherein the light guide is provided with a circular or ellipsoidal design in cross-section.

12. The illuminating device according to claim 1, wherein an angle of the corner region of the light guide and the reflector extends in a plane substantially perpendicular to the main emission direction.

* * * * *